US006990209B2

(12) United States Patent
Bodley et al.

(10) Patent No.: US 6,990,209 B2
(45) Date of Patent: Jan. 24, 2006

(54) HIGH DIRECTIVITY MICROPHONE ARRAY

(75) Inventors: Martin Reed Bodley, Sudbury, MA (US); Steve R. Lyman, Hudson, NH (US); Ian Paul Smith, Merrimack, NH (US)

(73) Assignee: GN Netcom, Inc., Nashua, NH (US)

( * ) Notice: Subject to any disclaimer, the term of this patent is extended or adjusted under 35 U.S.C. 154(b) by 284 days.

(21) Appl. No.: 10/281,646

(22) Filed: Oct. 28, 2002

(65) Prior Publication Data

US 2003/0198362 A1 Oct. 23, 2003

Related U.S. Application Data

(62) Division of application No. 09/478,268, filed on Jan. 5, 2000, now Pat. No. 6,473,514.

(51) Int. Cl.
*H04R 25/00* (2006.01)

(52) U.S. Cl. ..... 381/172; 381/356

(58) Field of Classification Search ..... 381/172, 381/355, 356, 361, 366, 369
See application file for complete search history.

(56) References Cited

U.S. PATENT DOCUMENTS 2,783,677 A * 3/1957 Becker ..... 381/304
4,311,874 A * 1/1982 Wallace, Jr. ..... 381/87
4,412,105 A * 10/1983 Muscatell ..... 381/172
5,848,172 A * 12/1998 Allen et al. ..... 381/356
5,862,240 A * 1/1999 Ohkubo et al. ..... 381/356
5,881,156 A * 3/1999 Treni et al. ..... 381/361

* cited by examiner

*Primary Examiner*—Suhan Ni

(74) *Attorney, Agent, or Firm*—Altera Law Group, LLC

(57) ABSTRACT

A microphone array for providing a focused field of optimum audio reception is disclosed. The array has a series of interconnected microphones spaced within a housing. At a midpoint of the spaced microphones is an illuminated polarized centering marker which gives the user a visual signal that the user is located within the optimum filed of audio reception. The housing can be placed on the top front edge of video monitor and has slideably mounted removable feet, which allow the microphones to be aimed more accurately at the user. The array is foldable along a midpoint, which allow for compact storage. The folding mechanism is a hinge, which has a hollow core, and openings which allow the internal wiring to interconnect two wings of the array without exposing the wires. The wings are held in their longitudinally oriented position by a latching mechanism of pins in one wing which snap fit into capture boots within the other wing. Microphones are maintained in sound deadening pods, which absorb side and rear audio signals and provide rear pressure relief.

5 Claims, 24 Drawing Sheets

HIGH DIRECTIVITY MICROPHONE ARRAY

This application is a Divisional application of prior application Ser. No. 09/478,268 filed on Jan. 5, 2000 now U.S. Pat. No. 6,473,514 entitled High Directivity Microphone Array.

TECHNICAL FIELD

This invention relates to the technical field microphone arrays and housing therefore.

BACKGROUND

Use of a microphone while operating a computer or similar terminal device has demanded a new type of highly directional microphone to selectively receive the voice of the speaker situated directly in front of it, but with the ability to cancel or reject sounds coming from other directions. This is particularly important in an open workstation environment where there is little sound insulation from the sides and rear. Furthermore, speech-to-text applications take accurate reception of the audio from the speaker all the more critical.

Prior art devices range from simple single unit element microphone with an adhesive base mounted on the top of a video monitor, to the use of headsets. The first solution is generally inadequate to provide sufficient sound isolation and the headset concept, while highly effective, requires the user to wear the headset in some cases still requires the user to be tethered to some part of the computer.

The present invention overcomes the problems inherent in prior "set top" mounted solutions while providing a highly direction microphone in a hands free, untethered environment.

The solution to the above problems lies in both the supporting electronics for the array and the cabinet design and microphone placement. The placement and electronics solutions are addressed in U.S. patent application Ser. No. 09/191,208 filed Nov. 12, 1998, which is specifically incorporated herein by reference. The solution to the cabinet is addressed in this application.

As to the cabinet, there is a need to mount the microphone array in a way to maximize its effectiveness, yet provide a convenient enclosure which will fit on monitors (or other fixtures like an automobile dashboard) of different sizes and shapes. Finally, it is important that a mobile solution be available so that the length of the array, which contributes to its effectiveness, will not detract from the transportability of the product.

It is also important that a structure be provided to warn the user to stay positioned in the field of optimum audio capture defined by the array.

The present invention addresses these issues and the invention comprises each individual solution as well as combinations of solutions.

BRIEF DESCRIPTION OF THE INVENTION

The invention can be characterized in many different ways and combinations. The following summary may be helpful in getting a general understanding of the invention in its many forms. Be aware however that the invention is defined by the claims which follow the specification and not by any summary information contained herein.

The invention relates to a microphone array preferably having an elongated housing for holding a series of spaced apart microphones. The housing is preferably formed in two half wings, the wings being hinged together at one of their ends to allow for folding at the hinge.

In one embodiment the housing has removable fee.

In another embodiment the feet are adjustable along a slot.

Another configuration of the array has an indicator which allows the user to know when he/she is speaking from the proper position, i.e. with the field of optimum audio reception.

Another configuration provides a locking mechanism to hold the winds in an extended open position, and additionally may provide a latching mechanism for maintaining the wings in a folded position (feet removed) for transport.

The array may also have structure for permitting the passage of wires through the hinge itself so that no exposed wires appear outside the housing.

The above summary of the present invention is not intended to describe each illustrated embodiment or every implementation of the present invention. The figures and the detailed description which follow more particularly exemplify these embodiments.

DETAILED DESCRIPTION OF THE DRAWINGS

The figures form a part of the invention disclosure and are used to illustrate a preferred embodiment but not to limit the scope of the claims to that embodiment:

In the following, the invention will be described in more detail with reference to the drawing, where FIG. 1 is a top perspective view of one the invention with feet removed;

Figure 13A:
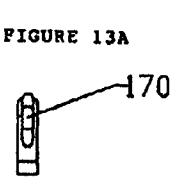
Figure 13C:
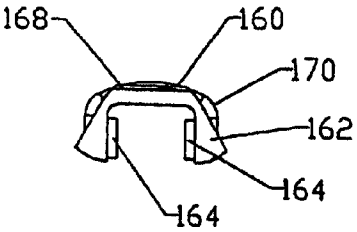
Figure 13B:
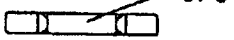
Figure 14:
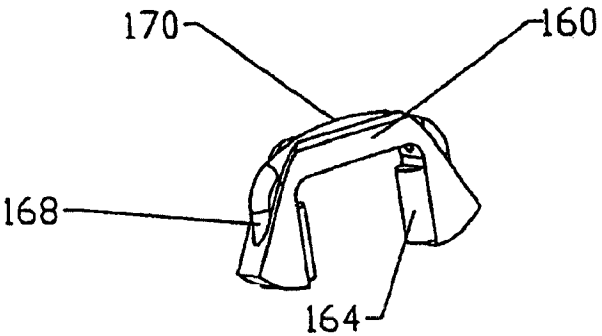
Figure 15:
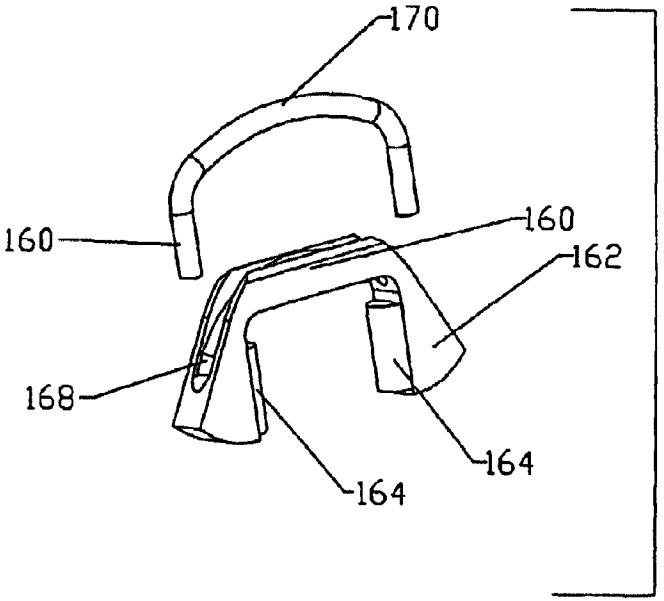
Figure 15A:
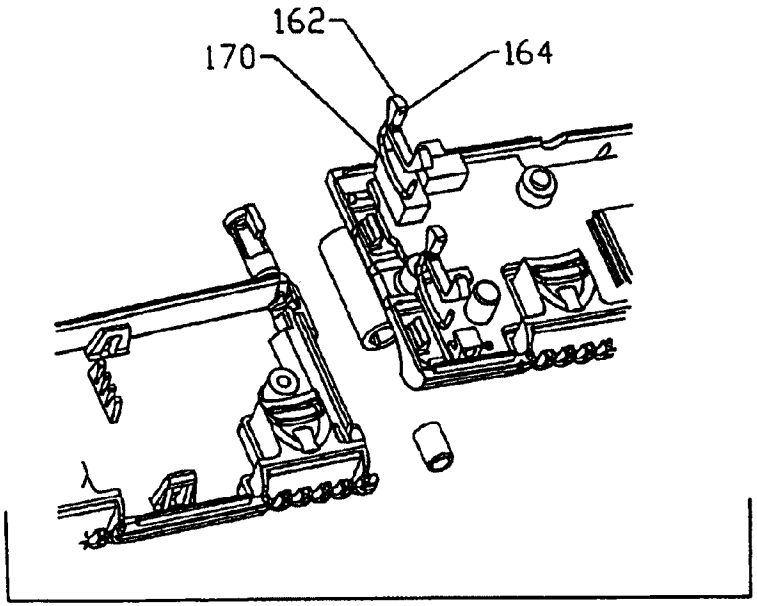
Figure 16:
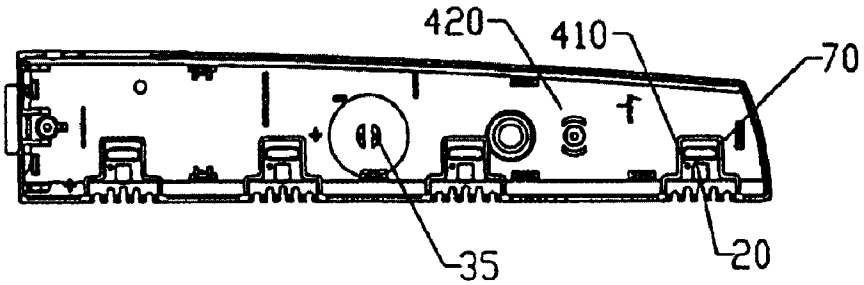
Figure 17:
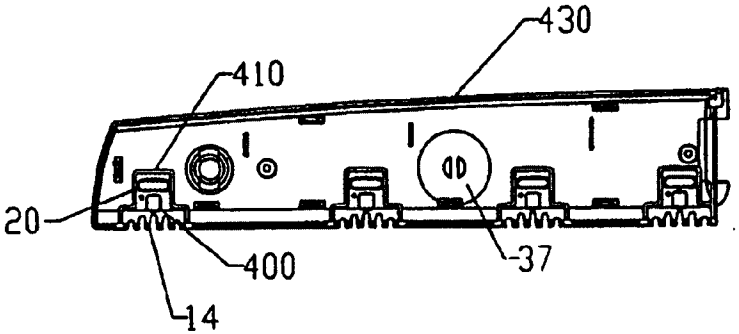
Figure 18:
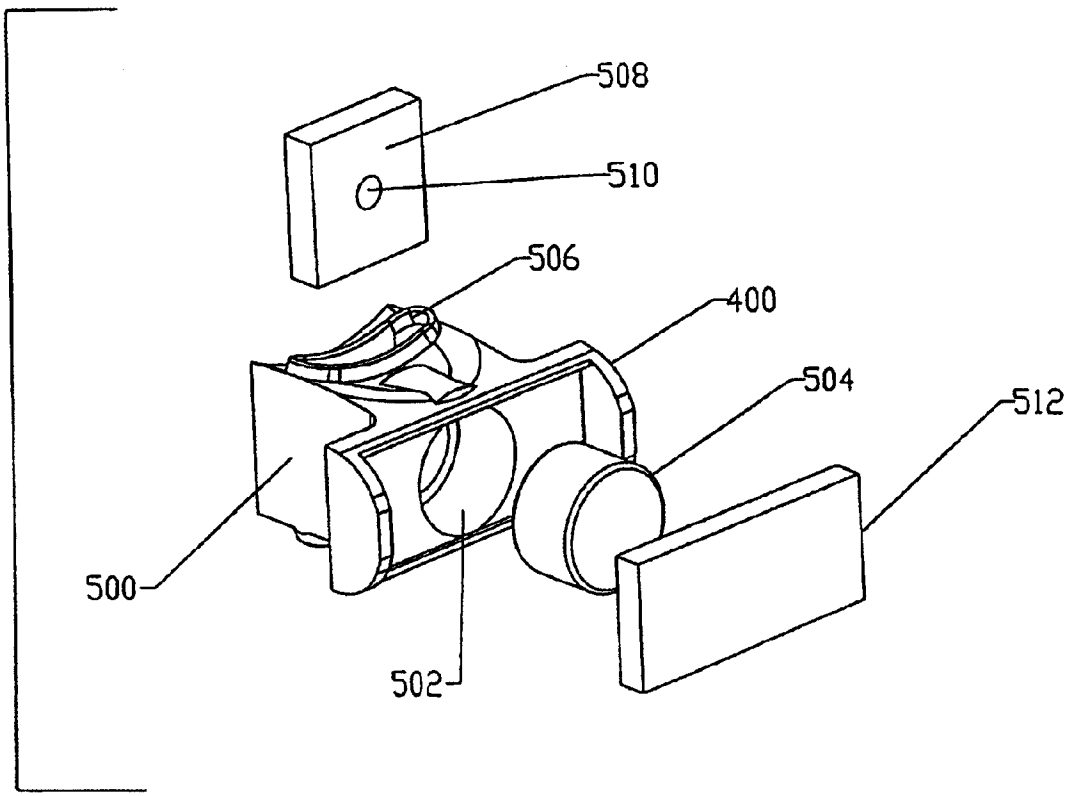
Figure 19:
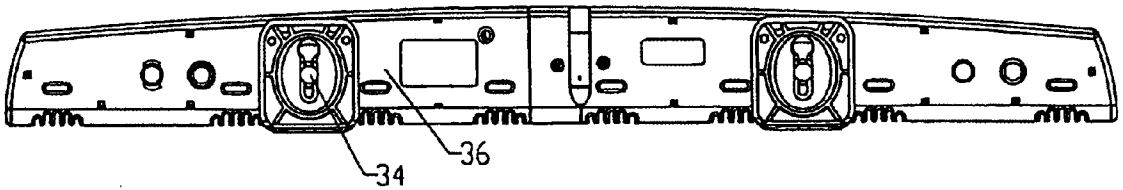
Figure 20:
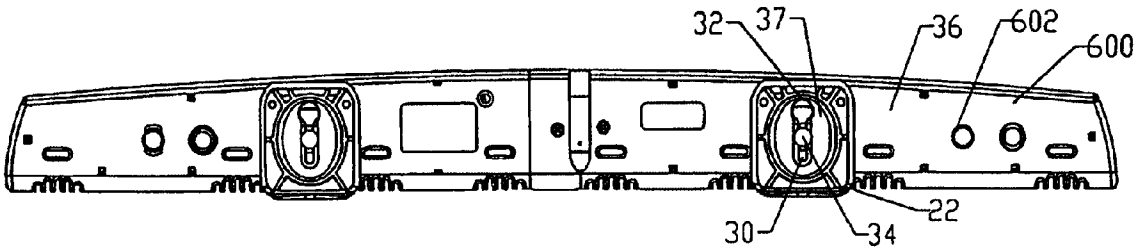
Figure 21:
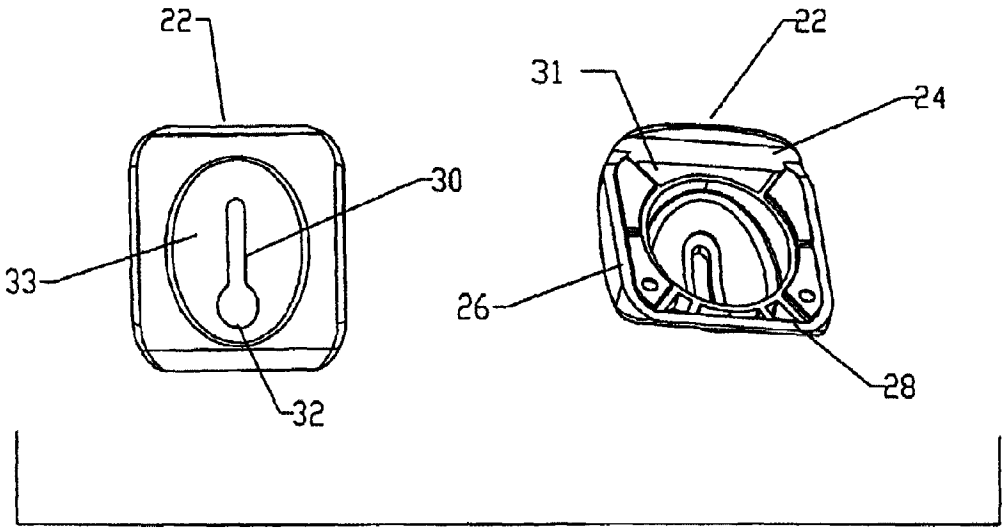
Figure 22:
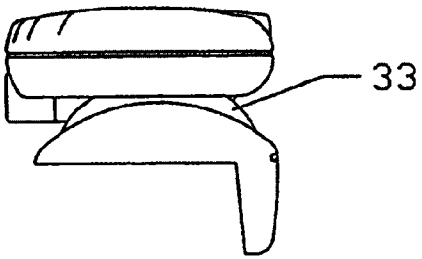

FIGS. 13*a*, 13*b*, and 13*c* are side, top and in plan views of the latching clip;

FIG. 14 is a perspective view of the latching clip;

FIG. 15*a* is an exploded perspective view of the latching clip in the housing;

FIG. 15 is a perspective view of the latching clip with portions removed;

FIG. 16 is a top perspective view of the lower housing portion as seen from the inside;

FIG. 17 is a view like FIG. 16 except with microphone pods shown;

FIG. 18 is an exploded view of a microphone pod;

FIG. 19 is a bottom perspective showing feet in place (non-folding);

FIG. 20 is a bottom plan view;

FIG. 20 a is a perspective view of the bottom with cross section in shadow;

FIG. 21 is a perspective view the feet;

FIG. 22 is a side plan view of the array with feet; and

Figure 23:
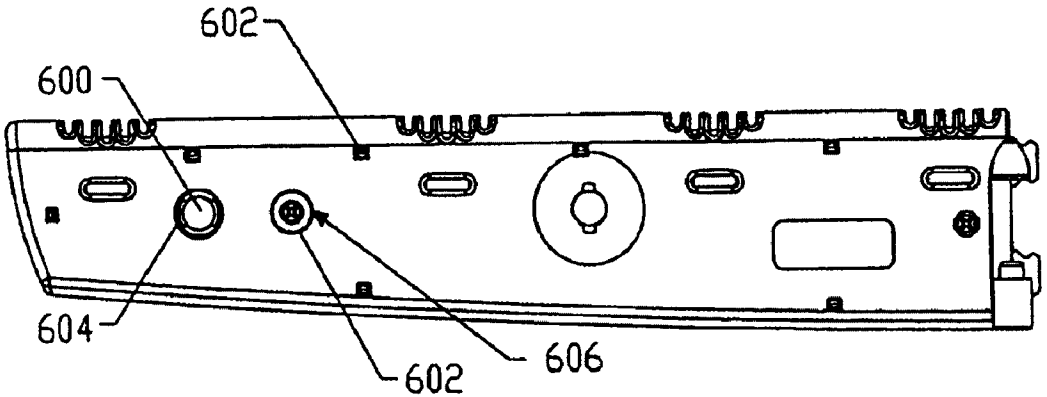

FIG. 23 is a bottom perspective close-up view of a locking recess.

DETAILED DESCRIPTION OF THE INVENTION

Figure 1:
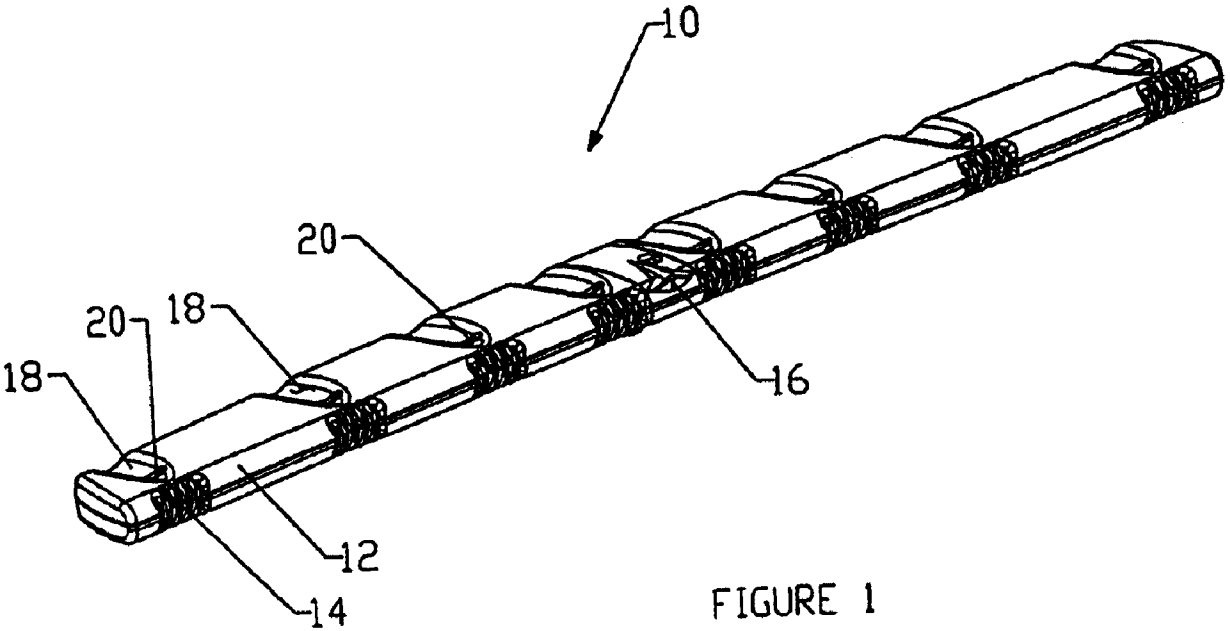
Figure 2:
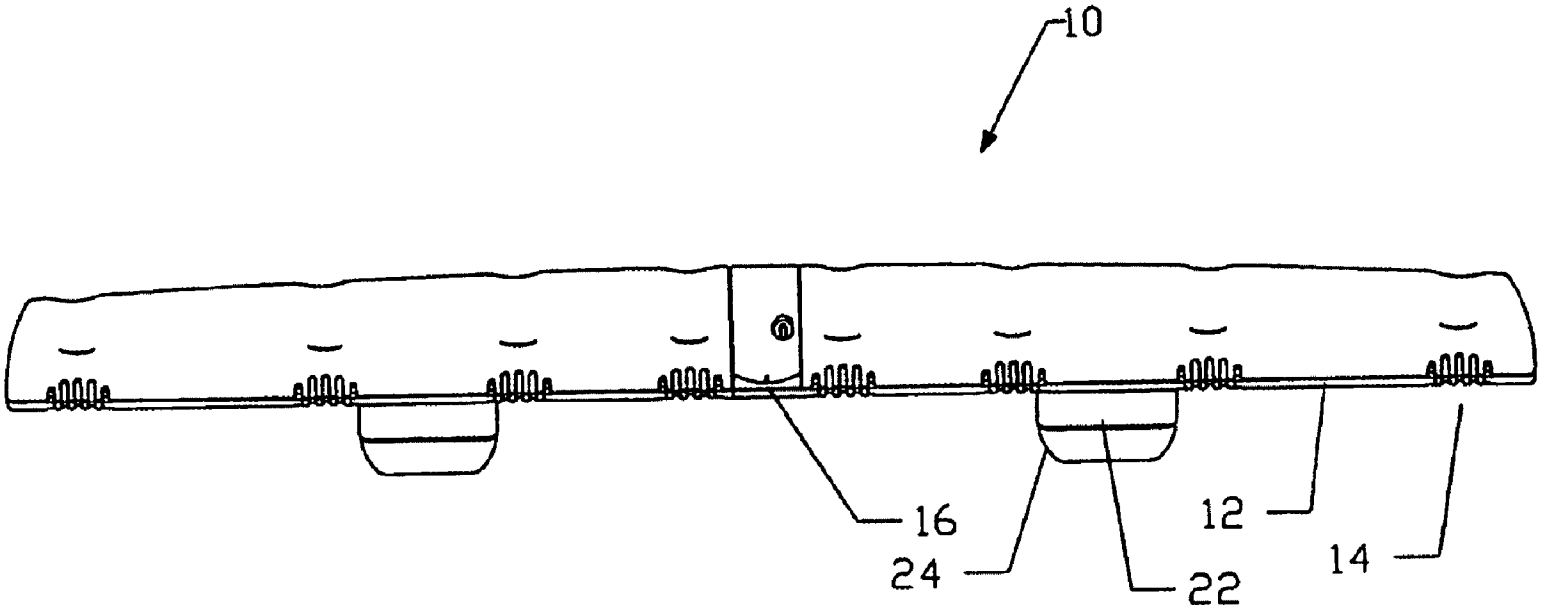
FIG. 2 is a perspective view of like FIG. 1, but non folding, with feet shown.
Figure 3:
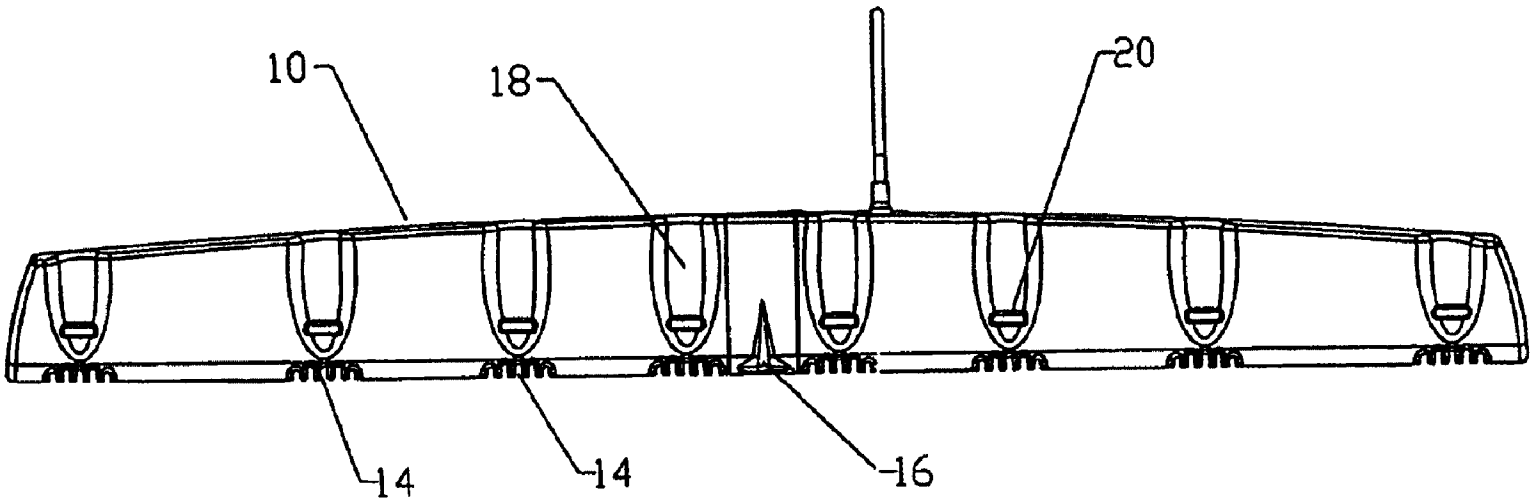
FIG. 3 is a pop plan view with feet removed.
Figure 4:
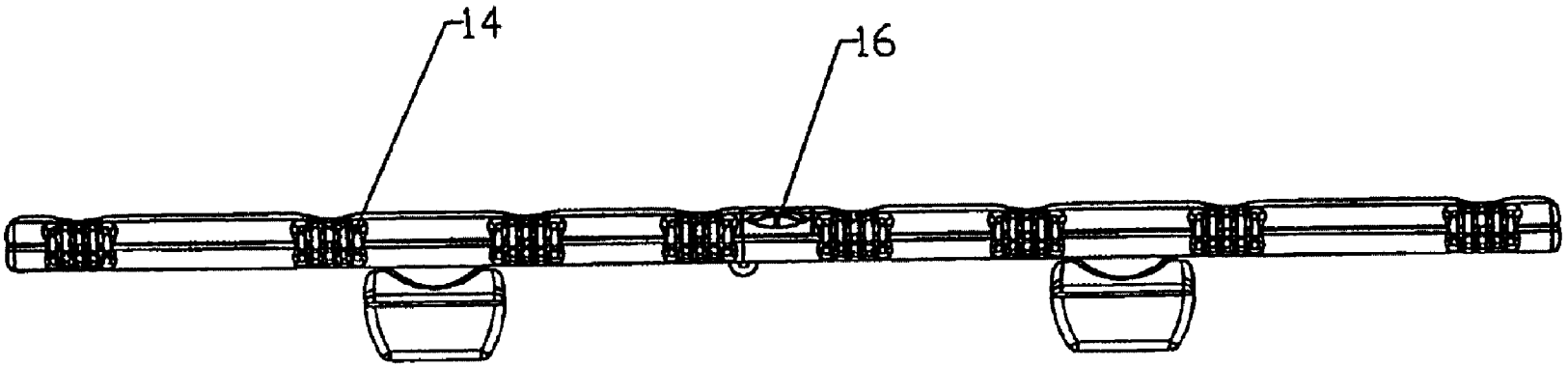
FIG. 4 is a front plan view with feet removed.
Figure 5:
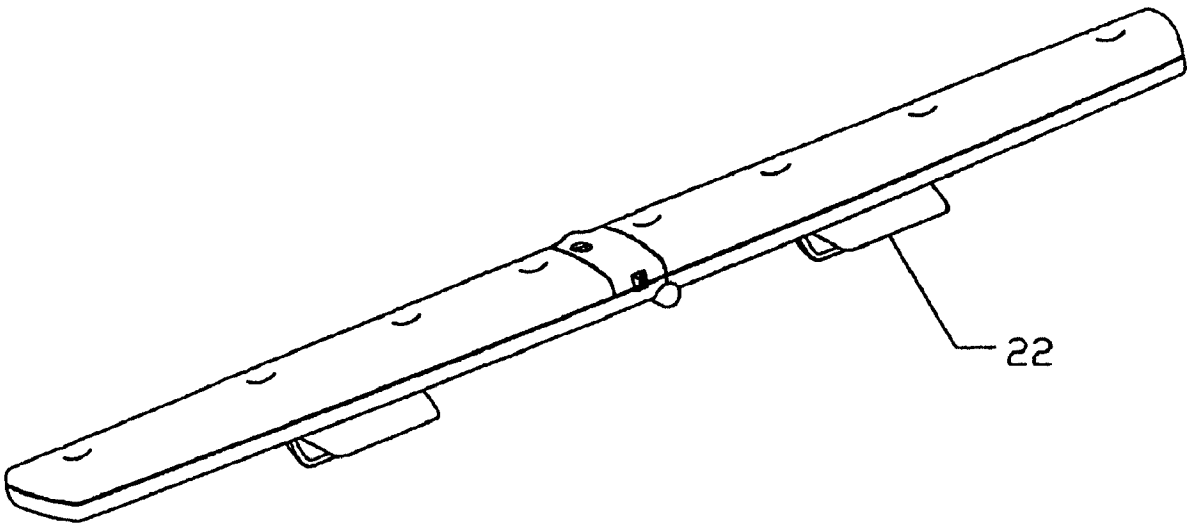
FIG. 5 is a rear perspective view, non folding, with feet attached.
Figure 6:
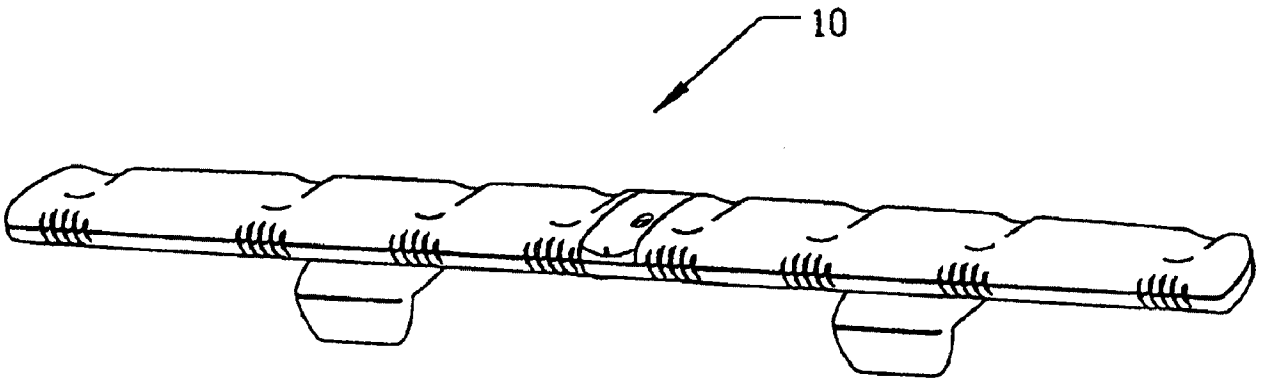
FIG. 6 is a top perspective view with portions broken away.

A microphone array assembly 10 is shown generally in FIGS. 1, through 6. It has a front face 12 with a series of slot apertures 14. The slots are parallel apertures of varying depth as shown in FIG. 2 from the most shallow on the outside to the deepest and tallest on the inside. The slots provide access to the microphone pods, which reside behind the slot apparatus. At approximately the center or midpoint along the elongated portion of the array is an aperture 16 which is used to provide a visual indication of in range placement. That is to say when the user is speaking into the array at the location within the optimum capture envelope of the array, the user will be able to see the illumination of the visual indicator, through aperture 16. An LED or other illumination device 116 resides directly behind the aperture. Aperture 116 is preferably formed in a slot formation so as to limit the viewability of the illumination device to a limited angle off dead center. The angle of viewability is determined by the width, of the slot and the depth at which the illumination device is located relative to the front face of the aperture. These parameters must be adjusted to achieve a viewability angle not greater than the acceptable range of capture for the microphone array. In the alternative, a polarizing light source could be provided so that the desired limitation on the viewable extent of the indicator can be controlled by the polarization alone.

The aperture 16 and illumination device 116 need not be placed in the center point of the array, if the above parameter are adjusted to accommodate the off center placement. On the top side of the array are depressions 18 and at the forward most end of the depression is an opening 20 which provides pressure relief for the microphone pods situated thereunder.

The preferable configuration is a "set-top" arrangement where the array is removablely resting on the edge of a video monitor, auto dashboard, or the like. It is however possible to build this structure into the facing of a video monitor or equivalent.

Figure 20A:
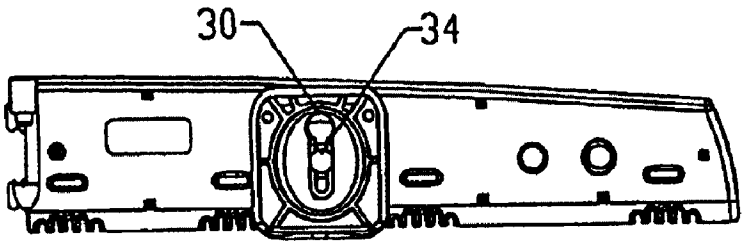

On the lower side of the array are found two movable and removable feet 22, shown in FIGS. 20, 21, 22. (A single foot or multiple feet are also possible.) Each foot is provided with a front lip 24 (see FIG. 21) which is intended to overhang the monitor or other resting shelf on which the array is situated, and a resting surface area 26, preferably covered by a gripping material such as neoprene. In the body of each foot is a concave recess 31 having a slot 30, which terminates at least one end in a circular opening 32. The concave recess appears a convex protrusion on the other side of the foot. The preferred shaped is oval or oblong though it could have parallel sidewalls, so long as it is curved. This circular opening 32 is sized to be slightly larger than a retaining cap 34, which extends out of the underside 36 of the array. The retaining cap 34 has a head sized just smaller than that of opening 32 and a neck 35 (visible in part in FIG. 16 and in shadow cross section in FIG. 20*a*) just smaller than slot 30. Neck 35 is long enough to just accommodate the thickness of material adjacent slot 30 so that the foot can slide in the space between cap 34 and the underside 36 array. On the underside of the array 36 (FIG. 20) the convex surface 33 of the foot is mated with a similarly shaped concave depression 37 in underside 36. The preferred shape of the depression 37 is circular as shown in FIG. 17. Though other shapes would suffice so long as the shape of the foot at the contact points with the underside would be in a slideable configuration relative to each other as the foot was moved along the slot 30. The resulting configuration provides a foot with full movement in 2 planes (x+y), i.e. the foot can tip forward or backward to adjust for the angle at which it contacts the monitor edge (or similar) and it may rotate right or left for similar reasons.

The right/left rotation is restricted if the neck is a planer member (parallel sides) and sized to fit the slot 30.

If the neck is cylindrical, full rotation is possible. Diamond or oval shapes will provide limited rotational freedom.

This permits feet 22 to be captured by the cap 34 and slide comfortably down slot 30 to accommodate different angles or orientation as maybe required by environmental considerations (such as the height of the user, the size of the monitor, the angle of the monitor, etc.). Each foot 22 is independently adjustable of the other. The feet 22 are removable for storage and transport.

Figure 7:
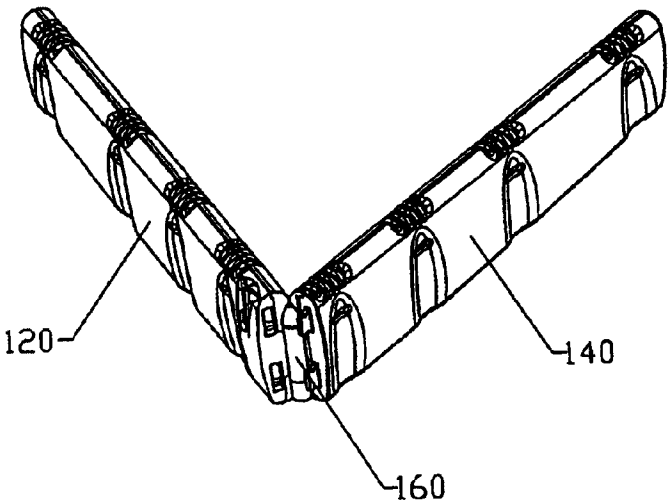
FIG. 7 is a perspective view in a partially folded position.
Figure 8:
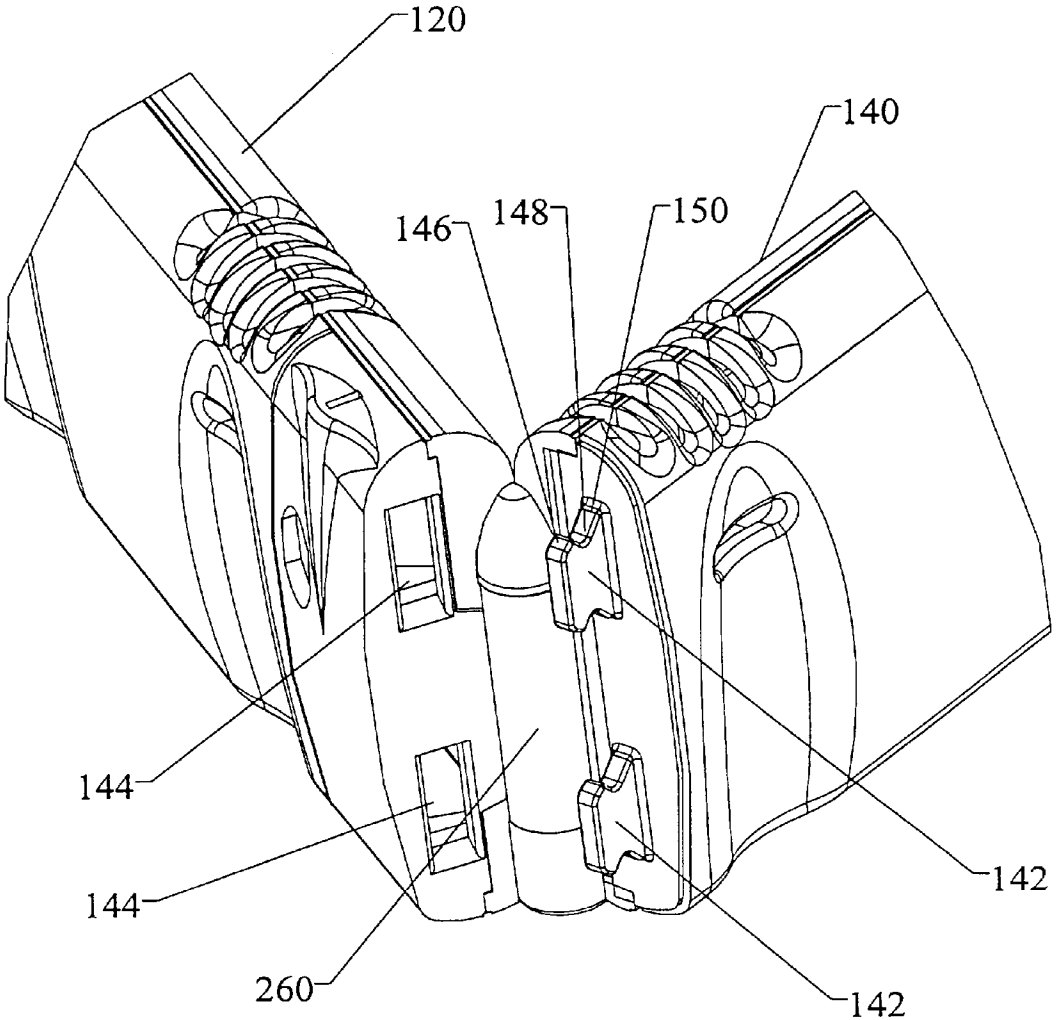
FIG. 8 is a perspective view in a partially folded position.
Figure 9:
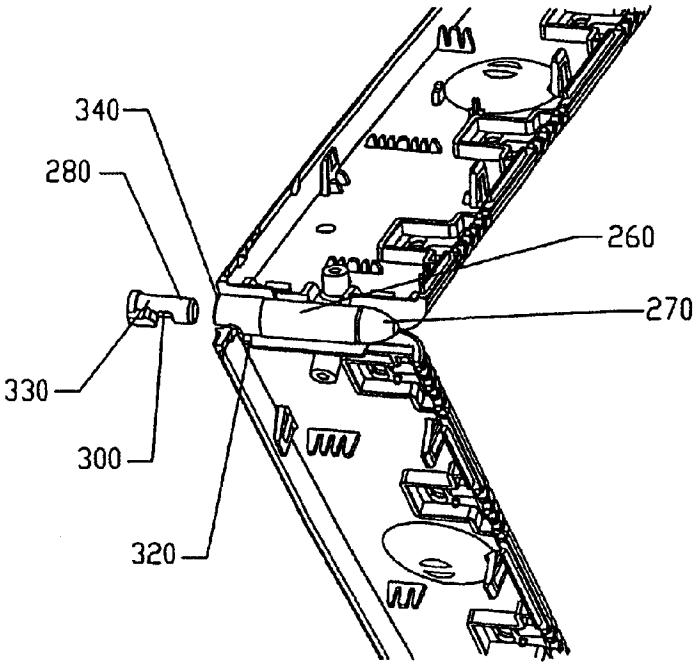
FIG. 9 is a close-up perspective view of the hinge.

In the preferred embodiment of the invention, the array 10 is foldable into two sections (wings) of preferably equal length 120 and 140 see FIG. 7 and 8. The halves are joined at a hinge 160. On half 140 there are preferably two locking projections 142 to be received within two locking apertures 144 on side 120. The projections have a wide first portion 146 and then a narrower neck 148 and a wider base portion 150. Apertures 144 have a latching or retaining clip 160. (See FIGS. 13*a, b, c*, 14 and 15) located just inside the housing adjacent apertures 144. The locking clip 160 includes a body element 162 with flanges 164. Apertures 168 are provided to receive a bias wire 170 which maintains flanges 164 biased in a predetermined horizontally opposed position. Locking mechanism 160 is maintained just behind apertures 144. When projections 142 pass through apertures 144, projections 164 on the U shaped locking clip 160 are briefly spread but under pressure of wire 170 quickly retract to engage the recess 148 in projections 142 thereby maintaining the two halves of the microphone array a locked-open position. When the array is folded, the reverse occurs permitting the removal of projections 142. Clips 160 are held in place adjacent apertures 144 by simple wall formations in the housing.

The array is preferably hinged see FIGS. 7 through 12. The hinge element 260 performs two functions. First, it allows the two halves 120 and 140 to swing on the hinge axis, but it also permits the passage of electrical conductors from one half to the other, without exciting the housing and exposing them to possible damage. Each microphone in the array has conductors which must be brought back from their respective housing halves to a circuit for signal processing. Therefore, hinge 260 has a hollow core and aperture on each half of the microphone array.

Figure 10:
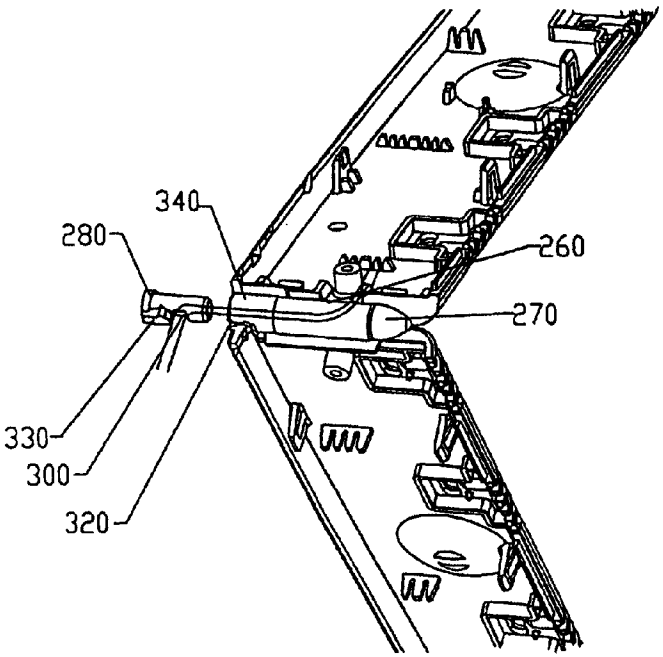
FIG. 10 is a view like FIG. 9 except a wire path is shown.
Figure 11:
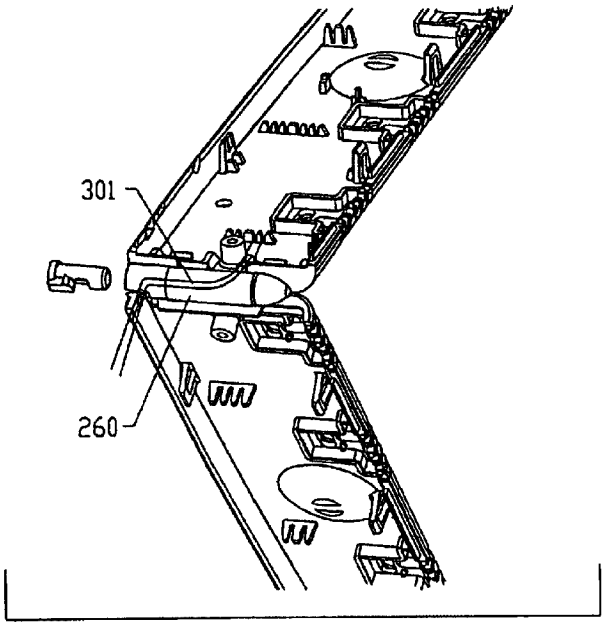
FIG. 11 is a view like FIG. 10 except that the removable hinge pin is fitted.
Figure 12:
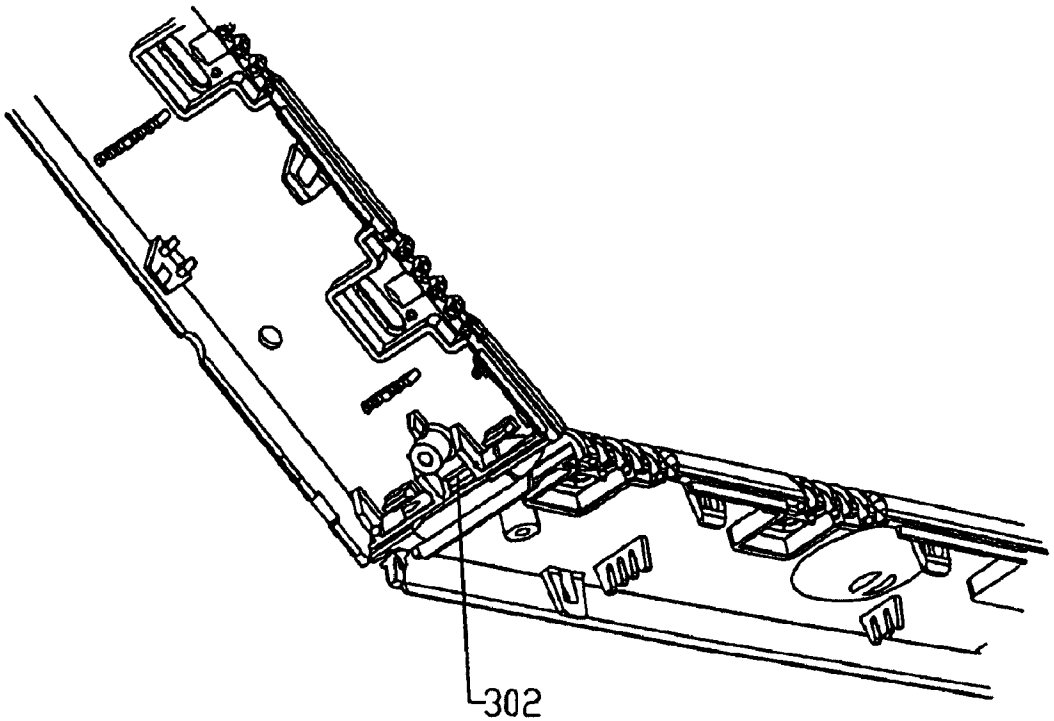
FIG. 12 is a view like FIG. 11 with the hinge removed to show other elements.

Turning to FIG. 10, hinge 260 is held in place by two halves of a hinge pin (the lower one held inside cap 270 and not otherwise visible and the upper hinge pin 280 is slideably removable from hinge 260). Hinge pin 280 has an aperture 300 in its side wall corresponding to a notch 320 in the hinged body itself which permits passage of wires 301 to pass into the hollow core of the hinge pin. Hinge pin 280 is removably maintained within the hinge body 260 by a baisable latch member 330, which engages a like-shaped receiving portion 340 on the hinge body 260. A like aperture 302 (See FIG. 12) on the other side of the hinge body 260 permits the exit of wires that were fed through aperture 300 into the hinge body and out into the other half of the microphone array via aperture 302. Consequently, the wires are maintained completely within the structure and are not visible to the user.

Microphone pod units 400 (see FIGS. 16 through 18) sit behind slotted apertures 14 and are confined in defined recesses 410 on both halves 420 and 430 (upper and lower) of the housing which comprises each wing (120, 140) of the microphone array housing. As mentioned earlier, apertures 20 are provided in both upper and lower halves of each wing and within microphone recesses 410. They provide pressure release against the incoming sound pressure.

The preferred construction of each microphone pod 400 is shown in FIG. 18. The main body is formed of a microphone receiving mount 500 having an aperture 502 sized to receive microphone element 504 and a further vertically oriented aperture 506 sized to receive a sound deadening and pressure relief block 508, typically made of rubber material and having an aperture 510 which also provides rear passage for the microphone wires. It is block 508 that engages apertures 20 in the two halves of the housing.

In front of each microphone unit 400 is a noise-canceling block 512 made of typical material found on the face of microphone elements.

The circuitry for interconnecting microphone units 400 is described in detail in U.S. patent application Ser. No. 09/191,208 fled Nov. 12, 1998 and incorporated herein.

In the folded position, the wings 120, 140, can be maintained in abutment by an option pin latch, comprising a recess 600, and projection 602. Actually, 600 and 602 do not mate with each other but with their reverse image counterpart (not shown) on the other wing. (That is, where projection 602 is located on this wing, a recess 600 will be on the other wing).

Recess 600 includes a ridge 604 (also shown in the cross section) and a like ridge 606 on the projection 602. The ridges are sized so that the projection cannot easily pass into the recess without a frictional encounter as the two ridges pass each other. In the alternative the diameter of projection 602 can simply be just larger than the inner diameter of ridge 604, which will insure a friction fit throughout.

It is understood that this has been a detailed description of the preferred embodiment, but that the invention encompasses a much broader range of possible substitutions of element to achieve the objection of this invention.

As noted above, the present invention is applicable to video display monitors, dashboards of vehicles, but that the inventive concepts can be applied anywhere where highly directional microphones in a hands-free is advantageous, including as a built in feature of any of the above. Accordingly, the present invention should not be considered limited to the particular examples described above, but rather should be understood to cover all aspects of the invention as fairly set out in the attached claims. Various modifications, equivalent processes, as well as numerous structures to which the present invention may be applicable will be readily apparent to those of skill in the art to which the present invention is directed upon review of the present specification.

We claim:

1. A microphone array comprising, an elongated housing for holding a series of microphones, said housing having a longitudinal dimension along which said microphones are spaced apart, said microphones being generally oriented to point in a direction orthogonal to said longitudinal dimension, thereby creating a focused area of optimal audio reception in front of said array; and wherein said housing includes a focal aperture generally at a midpoint of said spaced apart microphones;

an illumination device, within said housing, positioned to illuminate through said focal aperture, said aperture being sized to define an angular extent to which a user of the array may see illumination from the illumination device; and wherein said defined angular extent is substantially the same as the area of optimal audio reception of said array;

whereby the user of the array can identify the position for optional audio reception.

2. An array according to claim 1 wherein said aperture is vertical slot.

3. An array according to claim 1 wherein said illumination device includes a polarized light source.

4. An array according to claim 1 wherein said series of microphones has an optimum field of audio reception and wherein said focal aperture is a vertically aligned slot having a width sized to permit viewing of said illumination device only so long as the user is within said optimum field.

5. An array according to claim 1 wherein said series of microphones has an optimum field audio reception and wherein said focal aperture is a vertically aligned slot having a depth sized to permit viewing of said illumination device only so long as the user is within said optimum field.

* * * * *